United States Patent [19]

Kelly et al.

[11] 4,226,679

[45] Oct. 7, 1980

[54] LATCH MECHANISM FOR COKE OVEN DOORS

[75] Inventors: Calvin E. Kelly, Murrysville; Thomas E. Nicely, Delmont Borough, both of Pa.

[73] Assignee: United States Steel Corporation, Pittsburgh, Pa.

[21] Appl. No.: 12,268

[22] Filed: Feb. 15, 1979

[51] Int. Cl.[2] ..... C10B 25/12

[52] U.S. Cl. ..... 202/248; 110/173 R

[58] Field of Search ..... 202/248; 110/173 R

[56] References Cited

U.S. PATENT DOCUMENTS

| | | | |
|---|---|---|---|
| 2,812,292 | 11/1957 | Tucker, Jr. | 202/248 |
| 2,965,550 | 12/1960 | McClure | 202/248 |

FOREIGN PATENT DOCUMENTS

| | | | |
|---|---|---|---|
| 154953 | 1/1954 | Australia | 202/248 |
| 1104514 | 11/1955 | France | 202/248 |
| 692297 | 6/1953 | United Kingdom | 202/248 |

*Primary Examiner*—Frank W. Lutter
*Assistant Examiner*—Roger F. Phillips
*Attorney, Agent, or Firm*—Walter P. Wood

[57] ABSTRACT

A latch mechanism for coke-oven doors, which mechanism includes combination radial thrust bearings for the latch bars. These bearings afford adjustability in all directions for the latch bars to enable force to be applied uniformly to the sealing strips which extend around the perimeter of the door.

2 Claims, 1 Drawing Figure

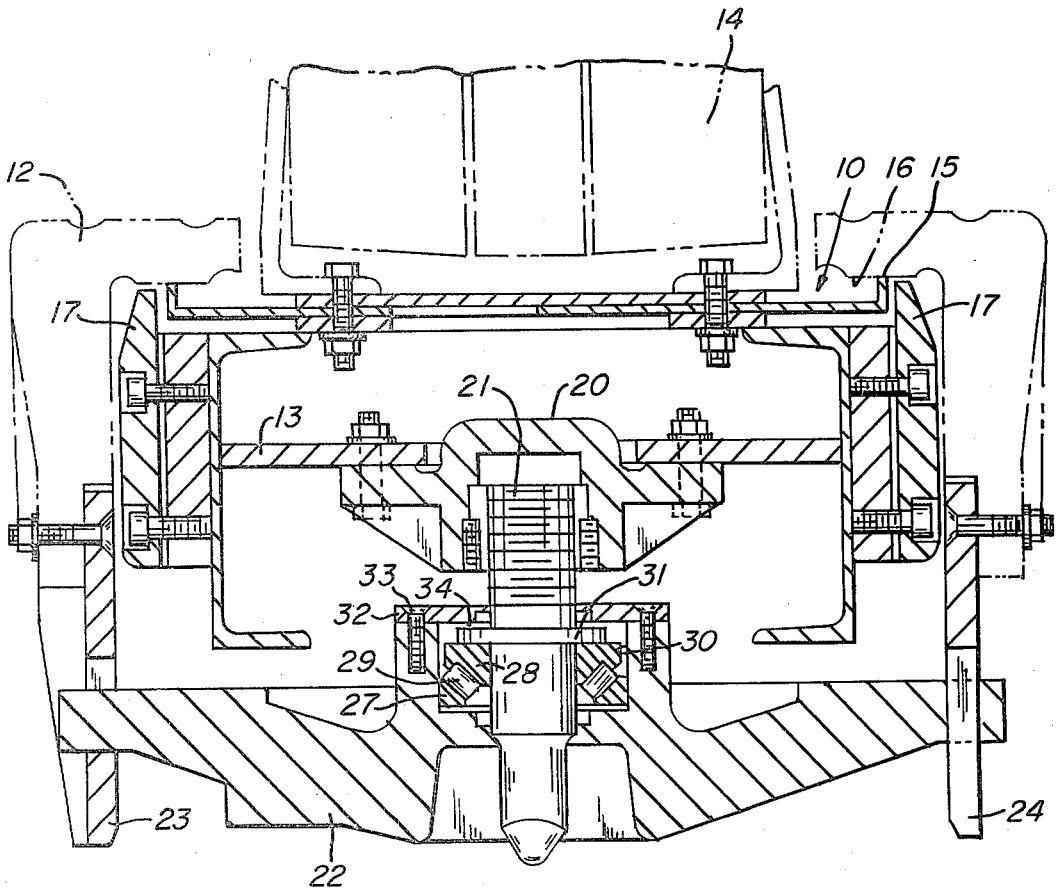
14
12
10
16
15
17
17
21
20
13
33
34
31
32
30
29
28
27
23
24
22

LATCH MECHANISM FOR COKE OVEN DOORS

This invention relates to an improved latch mechanism for a coke-oven door.

Conventionally a coke-oven door is held in closed position by a pair of latch bars which are pivoted to the front of the door and engage hooks which project outwardly from the jamb at opposite sides of the door. The door has a sealing strip which extends around its perimeter and abuts a flat surface of the jamb. After the latch bars engage their hooks, the sealing strip is forced into metal-to-metal contact with the flat surface of the jamb to effect a seal against gases escaping from the oven. Reference can be made to McClure U.S. Pat. No. 2,965,550 for an exemplary showing.

There is a problem that coke-oven parts tend to become misaligned, particularly under the heat of the oven, with the result that the door-latching force is not applied uniformly to the sealing strip. When the force or load is non-uniform, the sealing strip does not make proper metal-to-metal contact with the jamb, and leakage occurs.

An object of our invention is to provide an improved latch mechanism for a coke-oven door, which mechanism assures that the sealing strip is loaded uniformly.

A further object is to provide means which can be incorporated in conventional existing latch mechanisms for assuring that the sealing strip in the door is loaded uniformly.

In the drawing:

The single FIGURE is a horizontal sectional view of a coke-oven door which is equipped with our improved latch mechanism.

The drawing shows portions of a conventional coke-oven door 10 and jamb 12. The door includes the usual metal frame 13, refractory plug 14, and sealing strip 15 extending around the perimeter of the frame. The jamb has a flat surface 16 which the sealing strip abuts in metal-to-metal contact to effect a seal. Preferably the frame carries stop and guide bars 17 which assist in guiding the door to its closed position and in controlling the force with which the sealing strip 15 engages the surface 16, as shown and claimed in our earlier U.S. Pat. No. 4,125,438.

A nut 20 is fixed to the door frame 13 and a screw spindle 21 is threadedly engaged with the nut and projects outwardly from the frame. A conventional latch bar 22 is pivoted to the spindle 21 for rotation on a horizontal axis lying on the vertical center line of the door. A pair of conventional latch hooks 23 and 24 project outwardly from the jamb 12 at opposite sides of the door to be engaged by the bar for latching the door in closed position. The usual coke-oven door has two latch mechanisms, but since they are of similar construction, only one is shown.

In accordance with our invention, the latch bar 22 is mounted on a combination radial-thrust bearing which includes outer and inner races 27 and 28 and rollers 29 between the races. The latch bar has a bore 30 within which the outer race 27 is pressed. The inner race 28 is pressed on the screw spindle 21 against an integral flange 31 on the spindle. The axes of the rollers 29 lie at angles of about 40° to 50° to the axis of rotation of the latch bar. A retainer plate 32 is fixed to the latch bar with screws 33 and overlies the flange 31. There is a narrow gap 34 between the faces of flange 31 and plate 32 above said inner race.

In operation, when the door 10 is replaced on the oven after coke has been pushed, the latch bar 22 is rotated into engagement with the hooks 23 and 24. Next the screw spindle 21 is tightened to force the sealing strip 15 into metal-to-metal contact with the surface 16 on the jamb 12 in the usual manner. Both hooks 23 and 24 resist the screw force. If the two hooks are not perfectly in line or if any latch components are misaligned when the screw spindle 21 is tightened, the radial-thrust bearing affords automatic self-adjustability in the latch bar 22 in all directions. Thus the screw force is applied uniformly to the sealing strip 15.

From the foregoing description, it is seen that our invention affords a simple latch mechanism which automatically assures that the sealing strip on a coke-oven door is loaded uniformly around the perimeter of the door. Uniform loading of the sealing strip is important in preventing gases from escaping from the oven. Our invention can be incorporated readily in conventional existing latch mechanisms, such as shown in the aforementioned McClure patent, by replacing the bearings and adding the retainer plate.

We claim:

1. In a coke oven which includes a door having a sealing strip extending around its perimeter, a jamb having a surface to be contacted by said strip, and at least one latch mechanism for holding said door in closed position against said jamb, said latch mechanism comprising:

a screw spindle threadedly engaging said door and projecting outwardly therefrom;

a latch bar pivoted to said spindle; and a pair of latch hooks projecting outwardly from said jamb to be engaged by said bar but subject to being not perfectly in line;

the combination therewith of an improved mounting for said bar providing self-adjustability thereof in all directions relative to said spindle to correct for misalignment of said hooks;

said mounting comprising a combination radial-thrust bearing having outer and inner races and rollers between said races;

said bar having a bore in which said outer race is fixed;

said inner race being fixed to said spindle;

the axes of said rollers lying at angles of about 40° to 50° to the axis of said spindle; and means retaining said bar on said spindle but forming a gap above said inner race to allow self-adjusting movement of said bar.

2. A combination as defined in claim 1 including an integral flange on said spindle abutting said inner race, said gap lying between said flange and said retaining means.

* * * * *